US005709341A

United States Patent [19]

Graves

[11] Patent Number: 5,709,341

[45] Date of Patent: Jan. 20, 1998

[54] TWO-STAGE PLUNGER FOR RATE SHAPING IN A FUEL INJECTOR

[75] Inventor: Eric N. Graves, Manchester, N.H.

[73] Assignee: Caterpillar Inc., Peoria, Ill.

[21] Appl. No.: 642,293

[22] Filed: May 3, 1996

[51] Int. Cl.[6] ..... F02M 51/06

[52] U.S. Cl. ..... 239/92; 239/127; 239/533.4

[58] Field of Search ..... 239/92, 124, 127, 239/533.4, 533.9

[56] References Cited

U.S. PATENT DOCUMENTS

| | | | |
|---|---|---|---|
| 3,055,593 | 9/1962 | May et al. | 239/87 |
| 4,284,049 | 8/1981 | Chmela | 123/467 |
| 4,538,576 | 9/1985 | Schneider | 239/124 X |
| 4,618,095 | 10/1986 | Spoolstra | 239/124 X |
| 4,684,067 | 8/1987 | Cotter et al. | 239/533.3 |
| 4,811,899 | 3/1989 | Egler | 239/5 |
| 4,840,310 | 6/1989 | Haiden | 239/533.4 |
| 4,984,738 | 1/1991 | Winquist | 239/88 |
| 5,042,718 | 8/1991 | Bergmann et al. | 239/124 X |
| 5,263,645 | 11/1993 | Paul et al. | 239/124 |

FOREIGN PATENT DOCUMENTS

| | | | |
|---|---|---|---|
| 221243 | 8/1994 | Japan | 239/533.4 |

*Primary Examiner*—Kevin Weldon
*Attorney, Agent, or Firm*—Liell & McNeil

[57] ABSTRACT

The staged plungers can be incorporated into virtually any type of fuel injector that utilizes plunger movement to raise fuel pressure in order to initiate and sustain an injection event. The staged plungers include an outer plunger with a rate shaping spill port. An inner plunger having a rate shaping bore is positioned to reciprocate within the inner bore of the outer plunger. A compression spring biases the inner plunger toward an advanced position relative to the outer plunger. Toward the beginning of the staged plungers' downward stroke at the beginning of an injection event, their relative movement produces rate shaping in the fuel leaving the injector as well as producing a split injection as the rate shaping spill bore of the inner plunger opens to the rate shaping spill port of the outer plunger.

18 Claims, 4 Drawing Sheets

TWO-STAGE PLUNGER FOR RATE SHAPING IN A FUEL INJECTOR

TECHNICAL FIELD

The present invention relates generally to fuel injectors, and more particularly to fuel injectors having a two-stage plunger to provide rate shaping.

BACKGROUND ART

Engineers have long known that combustion efficiency and exhaust emissions can be improved by rate shaping the injection profile of a fuel injector. Engineers have noticed that reducing injection mass flow toward the beginning of each injection event can result in reduced NOx emissions. While many of the advantages of rate shaping can be produced by simply reducing injection mass flow toward the beginning of each injection event, more profound benefits can often be produced by creating a split injection. In such a case, each injection event includes a relatively small pilot injection separated in time from main injection by a brief decrease or pause in injection mass flow.

In the case of fuel injectors having a plunger that pressurizes the fuel during each injection event, rate shaping is sometimes provided by including a spill port that opens to a low pressure return line over a portion of the plunger's downward stroke. The plunger is typically driven downward by a hydraulically driven intensifier piston or a cam driven tappet. In either instance, the plunger spill port opens shortly after the plunger has begun its downward stroke and the injection of fuel has commenced. When the spill port opens, fuel pressure is relieved and the injection mass flow rate drops or ceases until the downward movement of the plunger again closes the spill port to begin main injection. One drawback to the use of a plunger spill port to provide injection rate shaping is the requirement that the plunger start at the same position for each injection event.

This renders the use of a rate shaping spill port in a fill metered injector unsuitable because the plunger in a fill metered injector begins its downward stroke at a different location for each different amount of fuel to be injected. Fill metered injectors are often desired because of their ability to provide an abrupt end to each injection event, which serves to improve exhaust emissions, especially avoiding the production of unburned hydrocarbons. An abrupt end to injection can be accomplished in fill metered injectors since the plunger ends its stroke at the same location for every injection event regardless of the amount of fuel to be injected. This facilitates the use of a terminating spill port in fill metered injectors that vent residual fuel pressure at the end of each injection event to provide an abrupt end to injection mass flow. In non-fill metered injectors, such a terminating spill port cannot be utilized since the plunger ends its stroke at a different location for each different amount of fuel that is injected.

Although the rate shaping concepts of the present invention can be applied to any fuel injector that utilizes a plunger to pressure fuel, the present invention is primarily directed to overcoming the problems of introducing rate shaping into a fill metered injector.

DISCLOSURE OF THE INVENTION

The present invention introduces rate shaping by providing staged plungers that move relative to one another during each injection event to provide injection rate shaping. The injector includes an injector body having a plunger bore that opens to a fuel supply passage and a nozzle chamber, and has a piston bore, and also a nozzle outlet that opens to the nozzle chamber. An intensifier piston is positioned to reciprocate in the piston bore between an upper position and a lower position. An outer plunger having an outer surface and an inner bore extending between an outer contact end and an outer pressure face end is positioned to reciprocate in the plunger bore between an advanced position and a retracted position. An inner plunger having a side surface extending between a contact end and a pressure face end is positioned to reciprocate within the inner bore of the outer plunger between an advanced position and a retracted position. Means, such as a compression spring, is provided for biasing at least one of the outer plunger and the inner plunger a distance away from the intensifier piston. A fuel pressurization chamber that opens to the nozzle chamber is defined by portions of the plunger bore, the outer plunger and the inner plunger. A check valve is positioned in the fuel supply passage and is operable to prevent flow of fuel from the fuel pressurization chamber back into the fuel supply passage. A needle check is positioned to reciprocate in the nozzle chamber between a closed position that closes the nozzle outlet and an open position that opens the nozzle outlet. The needle check includes at least one hydraulic lift surface exposed to the nozzle chamber. Finally, some means, such as a compression spring is provided for biasing the needle check toward its closed position. In this embodiment of the invention, rate shaping is provided by relative motion of the inner and outer plungers during each injection event.

In another embodiment of the invention, at least one of the inner plunger and the outer plunger has a rate shaping spill port that opens the fuel pressurization chamber to a low pressure spill passage over a portion of its downward stroke. In this embodiment, relative movement of the inner plunger to the outer plunger opens the spill port toward the beginning of each injection event to provide a split injection profile.

BEST MODE FOR CARRYING OUT THE INVENTION

Figure 1:
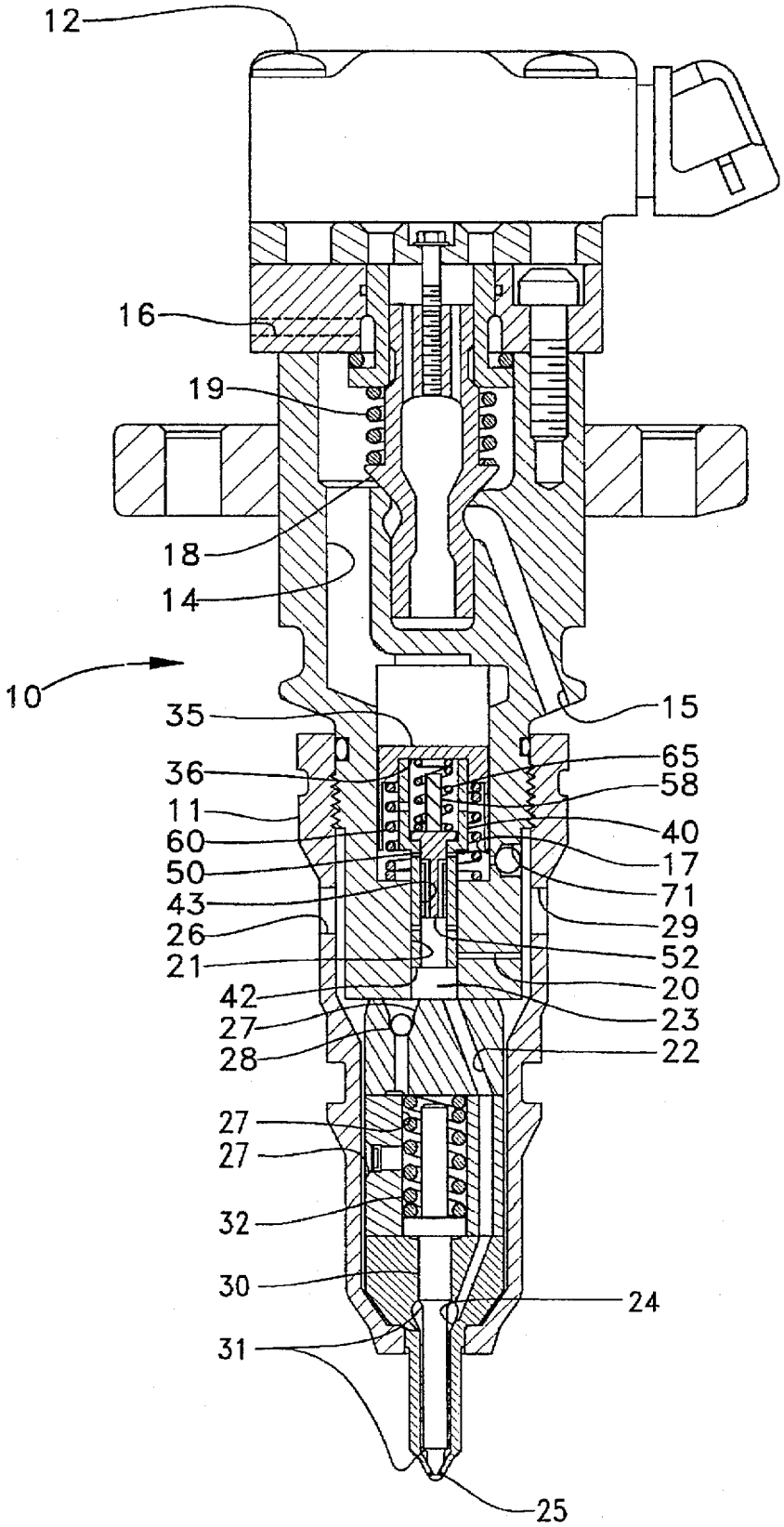
FIG. 1 is a sectioned side elevational view of a fuel injector according to the preferred embodiment of the present invention.
Figure 3:
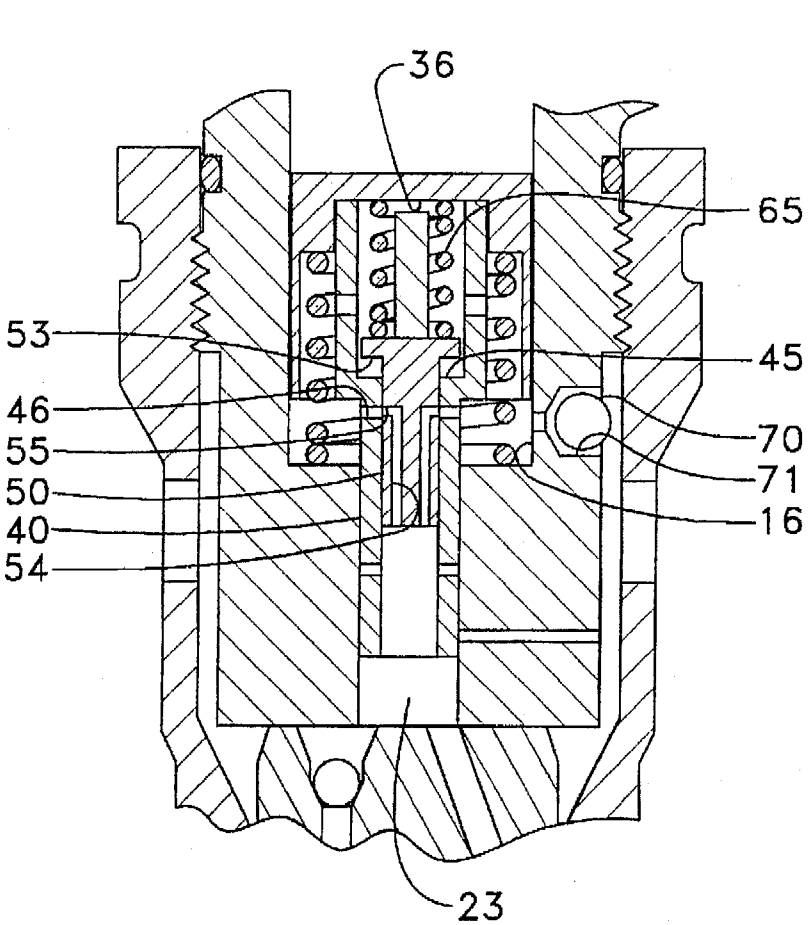
FIG. 3 is an enlarged sectioned side elevational view similar to FIG. 2 except showing the plunger's positions when the spill port opens during an injection event.

Referring now to FIG. 1, the present invention will be described for illustrative purposes as being incorporated into a hydraulically actuated electronically controlled fuel injector 10 of a type manufactured by Caterpillar, Inc. of Peoria, Ill. Injector 10 includes an injector body 11 that has a solenoid 12 attached thereto. The injector body includes an actuation fluid cavity 14 that opens to a high pressure actuation fluid inlet 15, a piston bore 17 and a low pressure actuation fluid drain 16, which is shown hidden in this sectioned view. The injector body also includes a plunger bore 21 that opens to piston bore 17, a fuel supply passage 27, a spill passage 20 and a nozzle supply passage 22. Finally, the injector body includes a nozzle chamber 24 that opens to nozzle supply passage 22 and a nozzle outlet 25.

A control valve member 18 is mounted within actuation fluid cavity 14. A compression spring 19 normally biases valve member 18 to close high pressure actuation fluid inlet 15 to actuation fluid cavity 14. When in this normally biased position, actuation fluid cavity 14 is opened to low pressure actuation fluid drain 16. When solenoid 12 is energized, control valve member 18 is lifted against the action of compression spring 19 to open high pressure actuation fluid inlet 15 to actuation fluid cavity 14. At the same time, valve member 18 closes actuation fluid cavity 14 to the low pressure actuation fluid drain 16.

A piston 35 is mounted to reciprocate within piston bore 17 between an advanced position and a retracted position, as shown. A compression spring 60 normally biases piston 35 to its retracted position. An outer plunger 40 is mounted to reciprocate within plunger bore 21 between an advanced position and a retracted position, as shown. Outer plunger 40 includes an inner bore 43 within which an inner plunger 50 is mounted to reciprocate between an advanced position as shown and a retracted position. A plunger stop 58 is positioned between inner plunger 40 and the underside 36 of piston 35. A compression spring 65 normally biases inner plunger 40 a distance away from piston 35. A portion of plunger bore 21, pressure face end 42 and inner bore 43 of outer plunger 40, and pressure face end 52 of inner plunger 50 define a fuel pressurization chamber 23.

A needle check 30 is positioned to reciprocate within nozzle chamber 24 between a closed position that closes nozzle outlet 25 and an open position that opens same. A compression spring 32 normally biases needle check 30 to its closed position. However, needle check 30 will lift to its open position when sufficient hydraulic pressure acts upon lift surfaces 31 against the action of return spring 32.

Normally, in this type of injector, fuel is circulated to a plurality of injectors that are connected in parallel. In particular, fuel enters injector 10 through fuel opening 26 and passes via a fuel supply passage 27 to fuel pressurization chamber 23. A check valve 28 positioned in fuel supply passage 27 prevents the back flow of fuel out of fuel pressurization chamber 23 when the plungers are undergoing their downward stroke during an injection event. Spill passage 20 interconnects fuel pressurization chamber 23 with a fuel return opening 29. Also, fuel return passage 71 interconnects fuel return opening 29 with piston bore 16. This configuration allows any fuel spilled into piston bore 16 to be pumped out into fuel return opening 29 for recirculation with each downward stroke of piston 35.

Although the general functioning of injectors of the type shown in FIG. 1 are well know to those skilled in the art, a brief review of its functioning will aid those skilled in the art in understanding the rate shaping concepts of the present invention. Each injection event is initiated by energizing solenoid 12 to open actuation fluid cavity 14 to high pressure actuation fluid inlet 15. The fluid pressure acting on the top of piston 35 causes it to begin its downward stroke. This downward movement of piston 35 also causes downward movement of outer plunger 40 and inner plunger 50. This movement of the plungers causes the fuel within fuel pressurization chamber 23 to be compressed. The pressure within fuel pressurization chamber quickly rises sufficiently to overcome the biasing force of check return spring 32. This hydraulic pressure acting on lift surface 31 causes needle check 30 to lift to open nozzle outlet 25, so the injection of fuel commences.

Each injection event ends when outer plunger 40 reaches the end of its stroke and opens fuel pressurization chamber 23 to terminating spill passage 20. When this occurs, the fuel pressure within fuel pressurization chamber 23 drops drastically allowing needle check 30 to close quickly under the action of check return spring 32. During a metering mode between injection events, solenoid 12 is de-energized to allow control valve member 18 to return to its lower seat closing high pressure actuation fluid inlet 15. At the same time, low pressure actuation fluid drain 16 opens to actuation fluid cavity 14 and allows fluid to escape therefrom. This permits outer plunger 40 and piston 35 to retract under the action of return spring 60. The next injection event is initiated when the desired amount of fuel for the next injection event has flowed into fuel pressurization chamber 23. The present invention is primarily concerned with controlling injection mass flow rate out of the injector during each injection event to provide an advantageous injection rate shape profile that improves combustion efficiency and reduces harmful emissions from an engine.

Figure 2:
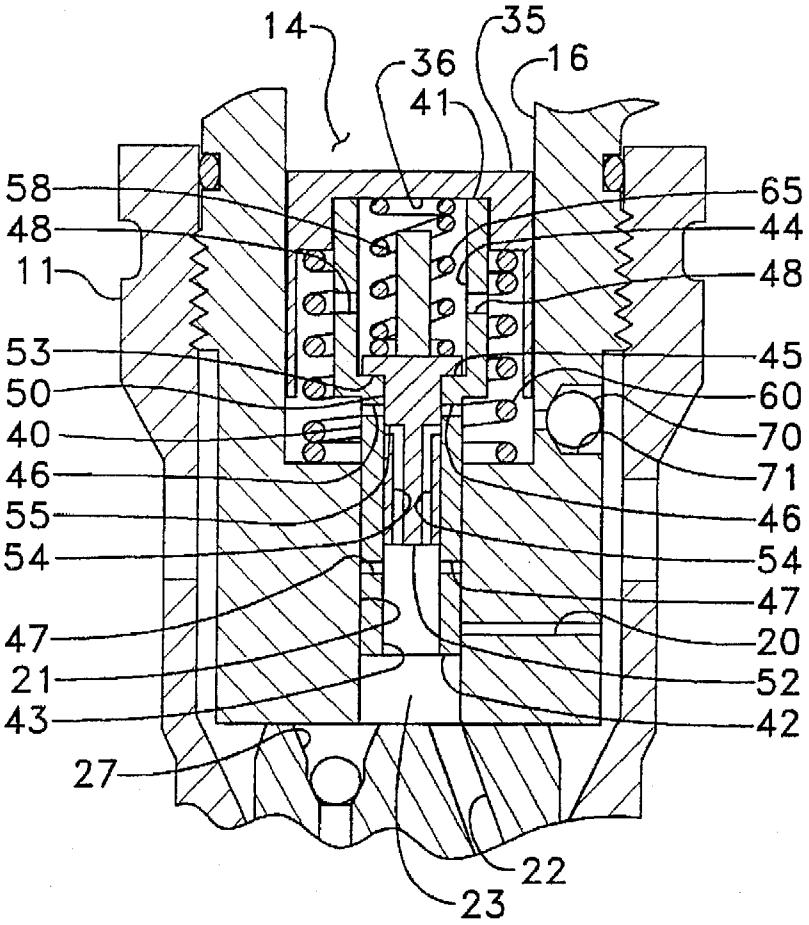
FIG. 2 is an enlarged sectioned side elevational view of the injector shown in FIG. 1 with the staged plungers positioned before the initiation of an injection event.
Figure 5:
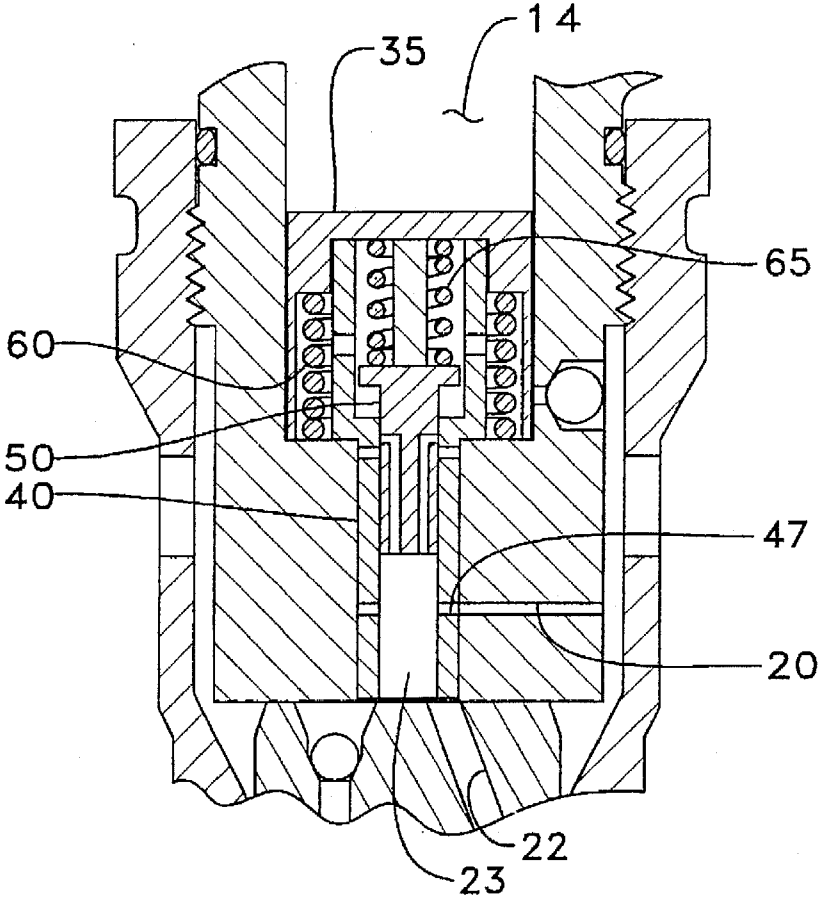
FIG. 5 is an enlarged sectioned side elevational view similar to FIGS. 2 and 4 except showing the plunger's positions at the end of an injection event.
Figure 6:
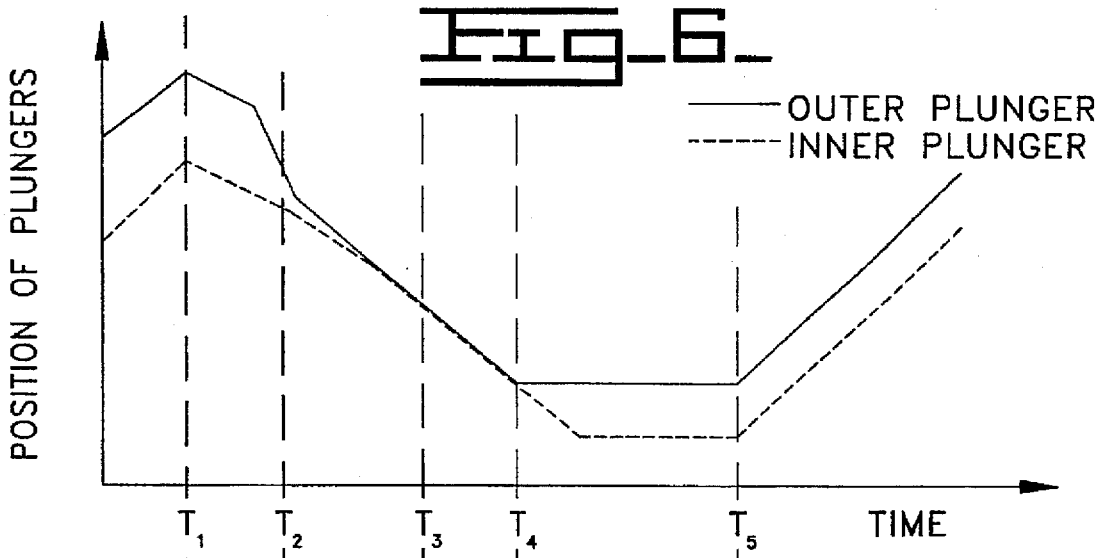
FIG. 6 is a graph of plungers' positions versus time over one injection cycle according to the present invention.

Referring now to FIGS. 2–8, the preferred functioning of the staged plungers according to the present invention will be described in relation to the fill metered example injector 10 shown in FIG. 1. FIG. 2 shows the plunger/piston configuration at a time $T_1$ corresponding to the beginning of an injection event. (See FIGS. 6–7). At time $T_1$, the desired amount of fuel for the next injection event has been metered into fuel pressurization chamber 23. Also, high pressure actuation fluid has begun flowing into actuation fluid cavity 14 to initiate the downward stroke of piston 35. Also at this time, inner plunger 50 is biased to its maximum distance away from piston 35 by the action of compression spring 65. When in this configuration, an annular head portion 53 of inner plunger 50 abuts an annular shoulder portion 45 of outer plunger 40. Compression spring 65 is capable of compressing a distance that is limited by the length of plunger stop 58, which has one end resting against the top surface of inner plunger 50. This distance is referred to in the claims as a "rate shaping distance." It is important to note that the spring constant of compression spring 65 is preferably chosen such that it will not compress until after the fuel within fuel pressurization chamber 23 has risen above that pressure (i.e. valve opening pressure VOP) which is necessary to open needle check 30 (FIG. 1) to commence the injection of fuel. This aspect of the invention is best illustrated in FIG. 6 where both outer plunger and inner plunger begin their downward stroke moving in unison between time periods $T_1$ and $T_2$.

Figure 7:
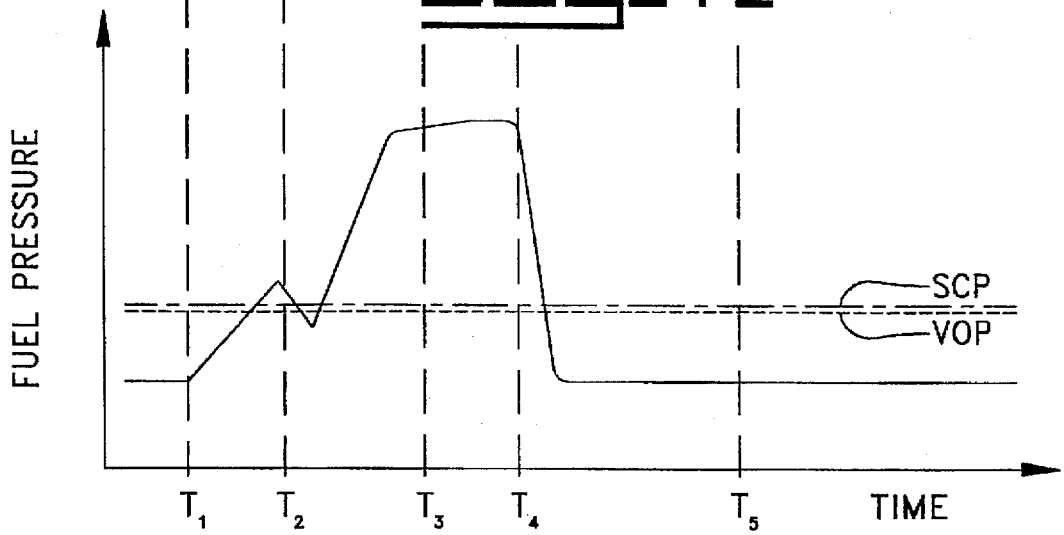
FIG. 7 is a graph of fuel pressure versus time over a single injection cycle.
Figure 8:
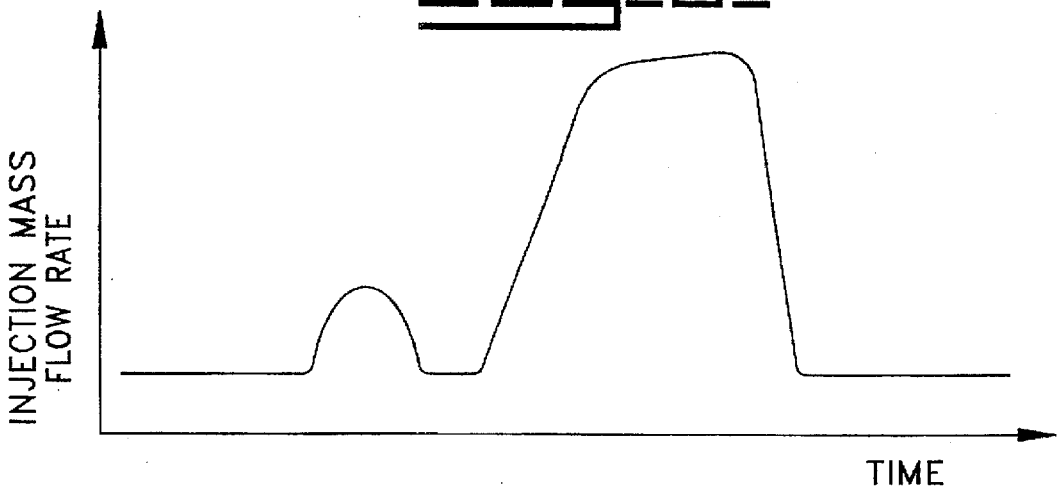
FIG. 8 is a graph of injection mass flow rate versus time over a single injection cycle.

As piston 35, outer plunger 40 and inner plunger 50 begin their downward stroke moving in unison, the fuel pressure within fuel pressurization chamber 23 quickly rises to a level sufficient to initiate injection. This is illustrated in FIG. 7 as the upward slope between time periods $T_1$ and $T_2$. Outer plunger 40 moves in unison with piston 35 since its contact end 41 is in contact with the underside 36 of the piston. Inner plunger 50 moves initially in unison with piston 36 because the fuel pressure within fuel pressurization chamber 23 is not yet sufficiently high to compress spring 65. Eventually the fuel pressure rises to a level sufficient to begin compression of spring 65. When this occurs, the downward movement of inner plunger 50 slows relative to that of outer plunger 40 and piston 35. Eventually, this relative movement causes rate shaping spill bore 54 and annulus 55 to align with rate shaping spill port 46 in outer plunger 40. Rate shaping spill port 46 opens between inner bore 43 and the outer surface of outer plunger 40. This alignment occurs at about time $T_2$. While rate shaping spill bore 54 and annulus 55 are open to rate shaping spill port 46, fuel spills through these passages into the lower portion of piston bore 17 causing the fuel within fuel pressurization chamber 23 to drop drastically in pressure. These spill passages are preferably sized large enough to preferably allow a sufficient amount of fuel to escape that fuel pressure within fuel pressurization chamber 23 drops below the valve opening pressure of the needle check. Those skilled in the art will appreciate that the present invention will produce some rate shaping results even if the spill passages are not sufficiently large to allow the fuel pressure to drop below the valve opening pressure of the needle check. It is important that the spill passages not be too large so that the relative momentum of the outer plunger to the inner plunger cannot cause outer plunger 40 and inner plunger 50 to continue moving relative to one another to close annulus 55 to rate shaping spill port 46. Any fuel that does spill into piston bore 17 is pumped out into return passage 71 past check valve 70.

Figure 4:
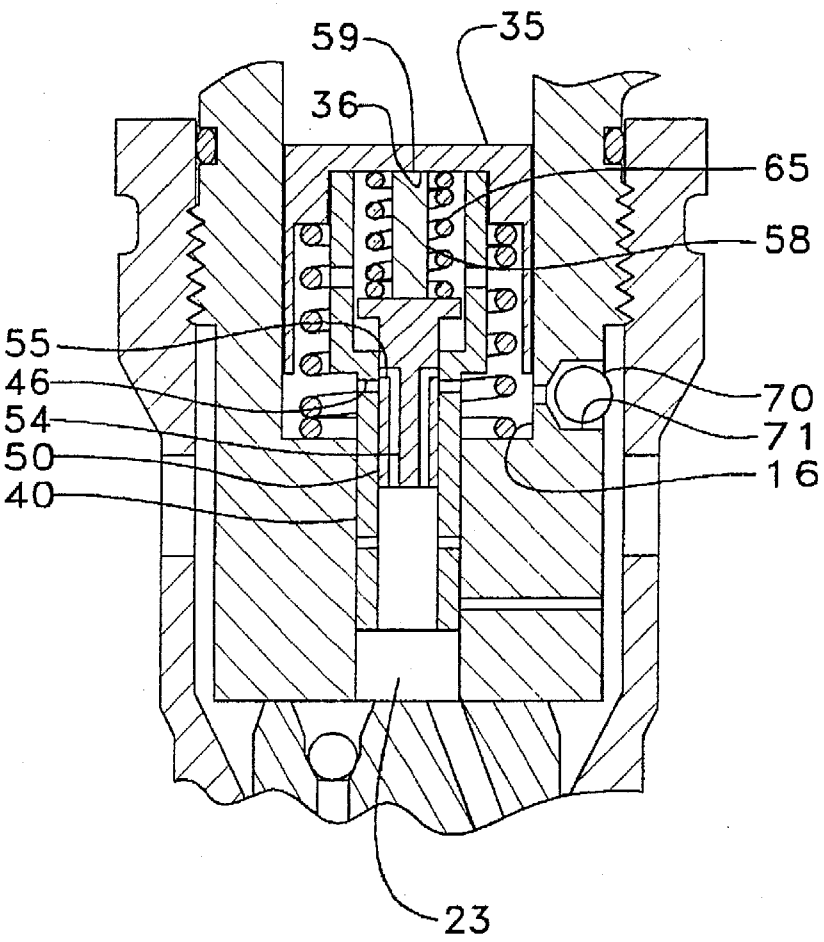
FIG. 4 is an enlarged sectioned side elevational view similar to FIGS. 2 and 3 except showing the plunger's positions during main injection.

When the spill passages (54, 55 and 46) again close, fuel pressure within fuel pressurization chamber 23 quickly rises above the valve opening pressure of the needle check, causing the needle check to reopen for the commencement of main injection. Also, the fuel pressure quickly rises to a level sufficient to continue compression of compression spring 65. This compression of spring 65 slows the rate at which pressure builds in fuel pressurization chamber 23. Thus even without the spill passages 54, 55 and 46, some rate shaping can be accomplished simply by the slower rate of increase in pressure produced by the relative motion of the inner plunger 50 to the outer plunger 40. This portion of the injection event is best seen in FIG. 6 between time periods $T_2$ and $T_3$, where the outer plunger and inner plunger are merging together. Eventually, the end 59 of plunger stop 58 comes into contact with the underside 36 of piston 35, causing the inner plunger 50 to again move in unison with outer plunger 40 and piston 35. This configuration is illustrated in FIG. 4, and corresponds to time period $T_3$ of FIG. 6, where the outer and inner plungers are again moving in unison. The remaining portion of the downward stroke of the outer and inner plungers produces the main injection portion of the injection event and functions for the remaining portion of their downward stroke substantially similar to the non-staged plunger alternatives of the prior art. As piston 35, outer plunger 40 and inner plunger 50 continue their downward stroke in unison, fuel pressure rises to peak levels corresponding to the maximum fuel flow rate out of the injector.

At the end of outer plunger 40's downward stroke, a terminating spill port 47 opens to spill passage 20 allowing pressure within fuel pressurization chamber 23 to quickly drop, causing an abrupt end to the injection event. This configuration is illustrated in FIG. 5 and corresponds in FIG. 6 to time period $T_4$. At this time, the downward movement of piston 35 and outer plunger 40 ceases even though actuation fluid cavity 14 is still open to high pressure actuation fluid inlet 15 (see FIG. 1).

Shortly after this terminating event, compression spring 65 acts to push inner plunger 50 back to its advanced position causing even more fuel to spill out of fuel pressurization chamber 23. This movement of inner plunger 50 is shown in FIG. 6 as the continued downward slope after time period $T_4$. Eventually, annular head 53 of inner plunger 50 comes again in contact with shoulder 45 of outer plunger 40, as shown in FIG. 2. The injector then enters a standby mode between time periods $T_4$ and $T_5$ when substantially no fluid is moving. At time period $T_5$, the metering mode of the injector begins by closing the high pressure actuation fluid inlet 15 and opening actuation fluid cavity 14 to low pressure actuation fluid drain 16. This allows piston 35, outer plunger 40 and inner plunger 50 to begin retracting under the action of return spring 60. Time $T_5$ is chosen such that the piston and plungers retract for a time period corresponding to an amount of time that allows a precise amount of fuel to meter into fuel pressurization chamber 23 for the next injection event.

Industrial Applicability

The staged plungers of the present invention accomplish rate shaping by two separate but related means. In particular, the compression of compression spring 65 decreases the rate at which fuel pressure builds underneath the plungers because of the relative movement of the inner plunger to that of the outer plunger. Those skilled in the art will appreciate that some rate shaping can be accomplished simply by providing staged plungers with at least one of the plungers biased away from the intensifier piston, without the inclusion of rate shaping spill ports. It being understood of course that a split injection of the type shown in the preferred embodiment would not be realistically possible without the inclusion of rate shaping spill ports. Nevertheless, the rate shaping provided by staged plungers without spill ports can gain some rate shaping advantages without the additional complexity of engineering rate shaping spill bores and spill ports in the inner and outer plungers, respectively.

As an alternative, staged plungers could accomplish rate shaping by including rate shaping spill ports but omitting any compression spring to bias one or both of the plungers away from the intensifier piston. In such a case, inertia and fuel pressure could be utilized to cause relative motion between the inner plunger and the outer plunger to carry the rate shaping spill bores and ports into brief alignment during the beginning portion of each injection event. In such a case, the relative position of the inner and outer plungers could be reset between injection events utilizing inertia, or possibly by hydraulic means, or even possibly by the inclusion of a relatively weak return spring. Thus, the preferred embodiment of the present invention has been shown as incorporating both the rate shaping effects produced by stages plungers with a compression spring and also by staged plungers that include rate shaping spill ports.

Although the present invention has been illustrated in relation to a hydraulically actuated fuel injector, the advantages of the staged plungers of the present invention could also be incorporated into a cam driven fuel injector in which the intensifier piston is either a tappet or moved by a tappet member. The present invention actually finds its most preferred application in fill metered fuel injectors because the plungers in such injectors start their downward strokes at different locations depending upon the amount of fuel to be injected. This fact has created great difficulty in introducing rate shaping into fill metered fuel injectors. Nevertheless, those skilled in the art will appreciate that the rate shaping concepts produced by the staged plungers of the present invention could also be applied to non-fill metered injectors. In fact, the staged plungers of the present invention could be incorporated into virtually any fuel injector that utilizes a plunger to pressurize fuel for an injection event.

Those skilled in the art will appreciate that the invention has been described above in only one example application. In addition to the other types of fuel injectors described which could benefit from the present invention, the fuel injector 10 illustrated earlier could also be modified without departing from the present invention. In particular, a three-way spool valve could be substituted for the two-way poppet valve illustrated in the example. In such a case, the injection mode and the metering mode of the injector can be de-coupled since such a valve has a position that closes both the high pressure actuation fluid inlet and the low pressure actuation fluid drain simultaneously. Also, the high pressure actuation fluid inlet and low pressure actuation fluid drains can be reversed such that each injection event is initiated by de-energizing the solenoid rather than energizing the solenoid as described above. In any event, the scope of the present invention is to be determined solely by the claims as set forth below.

I claim:

1. A fuel injector comprising:

an injector body having a plunger bore that opens to a fuel supply passage and a nozzle chamber, and having a piston bore, and also a nozzle outlet that opens to said nozzle chamber;

a piston positioned to reciprocate in said piston bore between an upper position and a lower position;

an outer plunger having an inner bore and being positioned to reciprocate in said plunger bore between an advanced position and a retracted position;

an inner plunger positioned to reciprocate in said inner bore of said outer plunger between an advanced position and a retracted position;

means for biasing at least one of said outer plunger and said inner plunger a distance away from said piston;

portions of said plunger bore, said outer plunger and said inner plunger defining a fuel pressurization chamber that opens to said nozzle chamber;

a check valve positioned in said fuel supply passage and being operable to prevent flow of fuel from said fuel pressurization chamber back into said fuel supply passage;

a needle check positioned to reciprocate in said nozzle chamber between a closed position that closes said nozzle outlet and an open position that opens said nozzle outlet, said needle check including at least one hydraulic lift surface exposed to said nozzle chamber; and means, within said injector body, for biasing said needle check toward said closed position.

2. The fuel injector of claim 1 wherein one of either said outer plunger or said inner plunger is in contact with said piston; and said means for biasing at least one of said outer plunger and said inner plunger a distance away from said piston is a compression spring separating the other of said outer plunger or said inner plunger from said piston.

3. The fuel injector of claim 2 wherein said outer plunger is in contact with said piston; and said means for biasing at least one of said outer plunger and said inner plunger a distance away from said piston is a compression spring separating said inner plunger from said piston.

4. The fuel injector of claim 3 further comprising a plunger stop that contacts said inner plunger and said piston when said compression spring compresses a rate shaping distance.

5. The fuel injector of claim 4 wherein said inner plunger has a rate shaping spill bore that opens to a low pressure spill passage over a portion of said rate shaping distance.

6. The fuel injector of claim 5 wherein said outer plunger has a rate shaping spill port; and said rate shaping spill port opens said rate shaping spill bore to said low pressure spill passage over a relatively small portion of said rate shaping distance.

7. The fuel injector of claim 6 wherein said rate shaping spill bore of said inner plunger extends between its side surface and its pressure face end; and said rate shaping spill port of said outer plunger extends between its outer surface and said inner bore.

8. The fuel injector of claim 7 wherein said injector body includes a spill passage extending between said plunger bore and a low pressure return opening;

said outer plunger includes a terminating spill port extending between said outer surface and said inner bore; and said spill passage aligning with said terminating spill port when said outer plunger approaches its advanced position.

9. The fuel injector of claim 8 wherein said injector body has an actuation fluid cavity that opens to an actuation fluid inlet, an actuation fluid drain and said piston bore; and a control valve mounted in said injector body and being movable between a first position that opens said actuation fluid inlet and closes said actuation fluid drain, and a second position that closes said actuation fluid inlet and opens said actuation fluid drain.

10. A fuel injector comprising:

an injector body having a plunger bore that opens to a fuel supply passage and a nozzle chamber, and having a piston bore, and also a nozzle outlet that opens to said nozzle chamber;

a piston positioned to reciprocate in said piston bore between an upper position and a lower position;

an outer plunger having an inner bore and being positioned to reciprocate in said plunger bore between an advanced position and a retracted position;

an inner plunger positioned to reciprocate in said inner bore of said outer plunger over a rate shaping distance;

portions of said plunger bore, said outer plunger and said inner plunger defining a fuel pressurization chamber that opens to said nozzle chamber;

at least one of said inner plunger and said outer plunger having a rate shaping spill port that opens said fuel pressurization chamber to a low pressure spill passage over a portion of its downward stroke;

a check valve positioned in said fuel supply passage and being operable to prevent flow of fuel from said fuel pressurization chamber back into said fuel supply passage;

a needle check positioned to reciprocate in said nozzle chamber between a closed position that closes said nozzle outlet and an open position that opens said nozzle outlet, said needle check including at least one hydraulic lift surface exposed to said nozzle chamber; and means, within said injector body, for biasing said needle check toward said closed position.

11. The fuel injector of claim 10 wherein said inner plunger has a rate shaping spill bore;

said outer plunger has a rate shaping spill port; and said rate shaping spill port opens said rate shaping spill bore to said low pressure spill passage over a portion of said rate shaping distance.

12. The fuel injector of claim 11 wherein said rate shaping spill bore of said inner plunger extends between a side surface and a pressure face end; and said rate shaping spill port of said outer plunger extends between an outer surface and said inner bore.

13. The fuel injector of claim 12 further comprising means for biasing at least one of said outer plunger and said inner plunger a distance away from said piston.

14. The fuel injector of claim 13 wherein one of either said outer plunger or said inner plunger is in contact with said piston; and said means for biasing at least one of said outer plunger and said inner plunger a distance away from said piston is a compression spring separating the other of said outer plunger or said inner plunger from said piston.

15. The fuel injector of claim 14 wherein said outer plunger is in contact with said piston; and said means for biasing at least one of said outer plunger and said inner plunger a distance away from said piston is a compression spring separating said inner plunger from said piston.

16. The fuel injector of claim 15 further comprising a plunger stop that contacts said inner plunger and said piston when said compression spring compresses said rate shaping distance.

17. The fuel injector of claim 16 wherein said injector body includes a spill passage extending between said plunger bore and a low pressure return opening;

said outer plunger includes a terminating spill port extending between said outer surface and said inner bore; and said spill passage aligns with said terminating spill port when said outer plunger approaches said advanced position.

18. The fuel injector of claim 17 wherein said injector body has an actuation fluid cavity that opens to an actuation fluid inlet, an actuation fluid drain and said piston bore; and a control valve mounted in said injector body and being movable between a first position that opens said actuation fluid inlet and closes said actuation fluid drain, and a second position that closes said actuation fluid inlet and closes said actuation fluid drain.

* * * * *